United States Patent [19]

Davis

[11] 4,284,150

[45] Aug. 18, 1981

[54] SOIL SAMPLING DEVICE

[76] Inventor: D. Lynn Davis, 310-28 St. So., Lethbridge, Alberta, Canada, T1J 3S6

[21] Appl. No.: 55,141

[22] Filed: Jul. 6, 1979

[51] Int. Cl.[3] ..... E21C 5/00

[52] U.S. Cl. ..... 175/84; 173/19; 173/24; 175/20

[58] Field of Search ..... 175/19, 20, 84, 161, 175/108; 173/19, 22, 24; 73/421 R, 421 B

[56] References Cited

U.S. PATENT DOCUMENTS

| | | | |
|---|---|---|---|
| 2,459,383 | 1/1949 | Levy . | |
| 2,709,368 | 5/1955 | Wolpert . | |
| 2,806,324 | 9/1957 | Ruth et al. | 173/19 |
| 3,264,877 | 8/1966 | Boyrud | 173/24 |
| 3,324,958 | 6/1967 | Clark | 175/84 |
| 3,331,249 | 7/1967 | Boyrud | 173/24 |
| 3,464,504 | 9/1969 | Stange | 175/161 |
| 3,748,907 | 7/1973 | Sahmel . | |

FOREIGN PATENT DOCUMENTS

| | | |
|---|---|---|
| 615274 | 2/1961 | Canada . |
| 630343 | 11/1961 | Canada . |
| 977578 | 11/1975 | Canada . |

*Primary Examiner*—James A. Leppink

*Attorney, Agent, or Firm*—Larson and Taylor

[57] ABSTRACT

A soil sampling device adapted to be mounted on a motor vehicle. The soil sampling device includes a tubular probe which is operated by means of a hydraulic cylinder and piston. A mechanism linking the probe with the piston causes the probe to swing from a horizontal position to a vertical position and then to move vertically downward into the soil. Upon withdraw from the soil the probe is caused to move vertically upward until clear of the soil and then to swing to a horizontal position with the end of the probe adjacent a sample collecting container. A second hydraulic piston and cylinder serves to eject the soil sample from the probe and into the collecting container. The controls for operation of the device are adapted to mounted at the vehicle operator's station.

5 Claims, 4 Drawing Figures

SOIL SAMPLING DEVICE

BACKGROUND OF THE INVENTION

This relates a soil sampling device for mounting on a vehicle such as a pickup truck.

Soil sampling devices of various types are known, however these suffer from a number of disadvantages. Accordingly it is desirable to provide a soil sampling device which can be mounted on a vehicle such as a pickup truck in such a manner as to permit the sampler device to be moved quickly and easily from one site to another without interferring with normal operation of the truck. It is also desirable that the soil sampling device be capable of obtaining samples at specific locations selected by the operator and without need of the operator dismounting from the driving position during the sample obtaining operation. It is also desirable that the sampling means be capable of penetrating the earth vertically in order to obtain a representative sample and that the device be capable of penetrating a compacted medium.

SUMMARY OF THE INVENTION

According to the present invention there is provided a soil sampling device having a tubular probe, a probe guidance means, and a probe motive means. The probe is operatively connected to the probe motive means and the probe guidance means so that during the course of continuous operation of the probe motive means in a first direction, the probe is caused to swing from a horizontal to a vertical position above the surface of the soil and then to move vertically downward penetrating the soil. When the probe motive means is operated in the direction opposite to the first direction the probe is caused to move vertically upward until clear of the soil and then to swing from a vertical to a horizontal position.

The invention also includes a hydraulic ram means which is adapted to pass through the hollow core of the probe when it is in the horizontal position, to cause the sample therein to be ejected onto a sample receiving container.

DESCRIPTION OF PREFERRED EMBODIMENT

Figure 1:
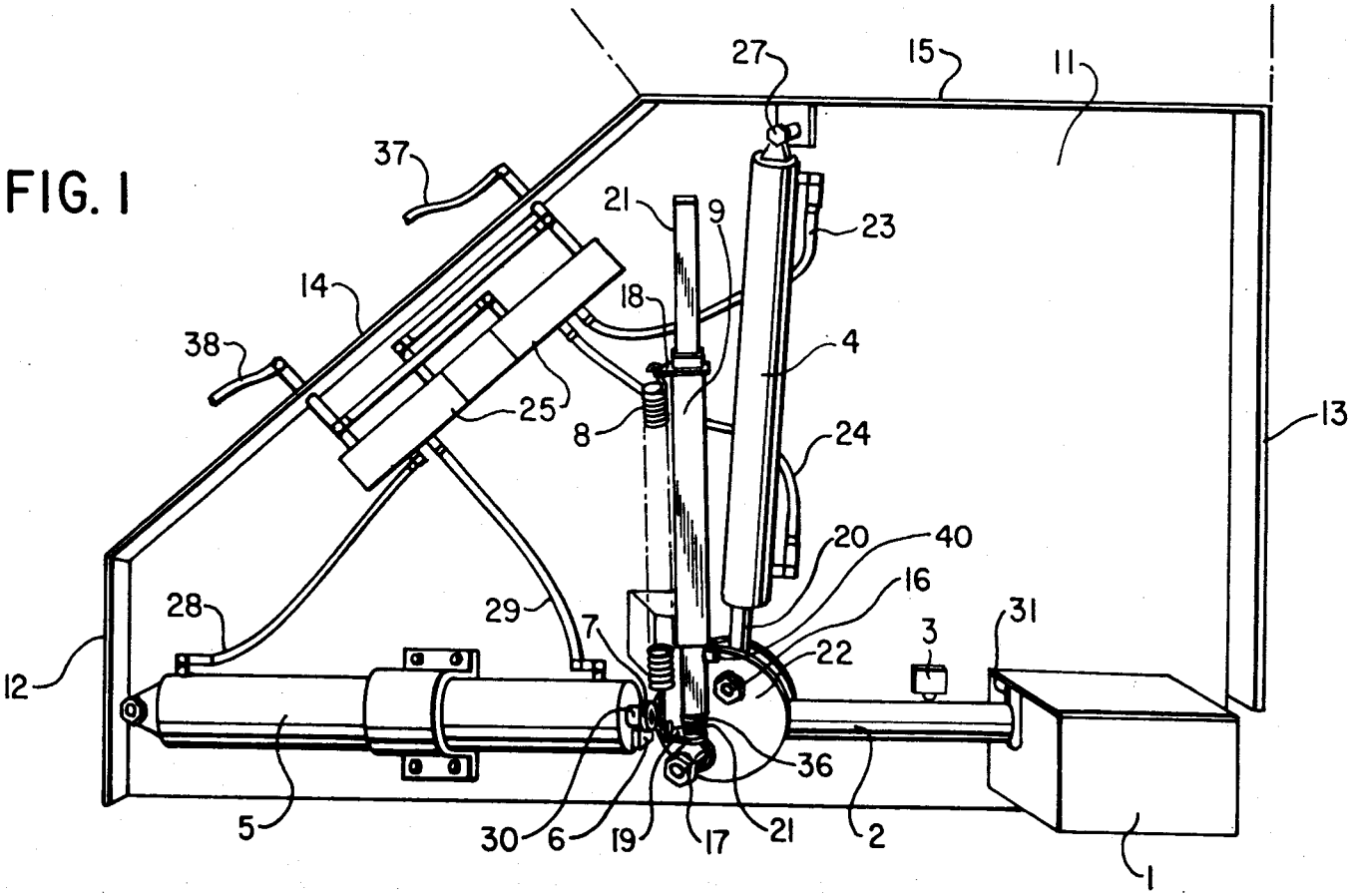
FIG. 1 is a perspective view of the soil sampling apparatus according to the present invention with the probe in a horizontal position.
Figure 3:
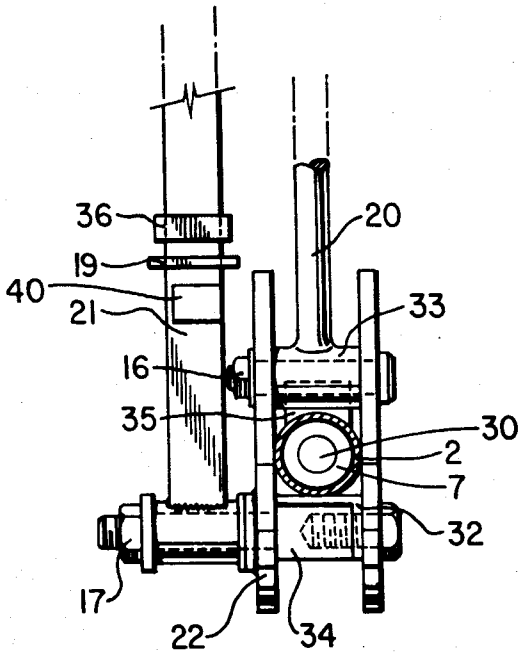
FIG. 3 is a view of the apparatus shown in FIG. 2 along Section 3—3.

As shown in FIG. 1 the device includes a housing comprising a back wall 11 and side walls 12, 13, 14 and 15. This device is adapted to be mounted on a motor vehicle for example on the side of a pickup truck.

Situated within the housing is the soil sampling apparatus including a sample probe 2 which is fixed to a swivel plate 22 in such a manner as to prevent relative movement between it and the swivel plate. The sample probe is shown in FIG. 1 in the sample discharging position. The probe includes an inside hollow cylindrical core or bore which is somewhat narrowed at the cutting tip to facilitate movement of the soil sample within the bore. Toward the outside circumference of the swivel plate 22 there is mounted a rotatable connector 16 which serves to pivotally connect one end of piston rod 20 to the swivel plate 22. The other end of the piston rod 20 is attached to a piston positioned within hydraulic cylinder 4. Connected to the cylinder 4 on opposite ends of the piston are flexible hydraulic lines 23 and 24 which are adapted to conduct hydraulic fluid to and from the hydraulic cylinder 4 to control movement of the piston rod 20. Hydraulic lines 23 and 24 are connected to an electrically controlled hydraulic value unit 25 which in turn is connected to a source of hydraulic pressure via lines 37 and 38. The cylinder 4 is pivotally attached to the back wall 11 of the housing by means of pivoted connector 27. A microswitch 3 is mounted on a bracket attached to the back wall. The microswitch 3 is positioned so as to be contacted by the sample probe 2 when it is in the sample discharging position shown in FIG. 1. The microswitch 3 is electrically connected to the hydraulic valve unit 25 to prevent operation of hydraulic cylinder rod 30 when the sample probe 2 is not in the discharge position.

A second rotatable connector 17 is mounted on the swivel plate approximately diametrically opposite to the connector 16. Connector 17 is attached to one end of guide rod 21 so as to provide a pivotal connection between the guide rod 21 and the swivel plate 22. The guide rod 21 is slidably positioned within guide tube 9 permitting linear reciprocal movement relative thereto. A tension spring 8 is attached at one end thereof to a bracket 18 on the guide tube and at the other end, to bracket 19 on the guide rod.

Figure 2:
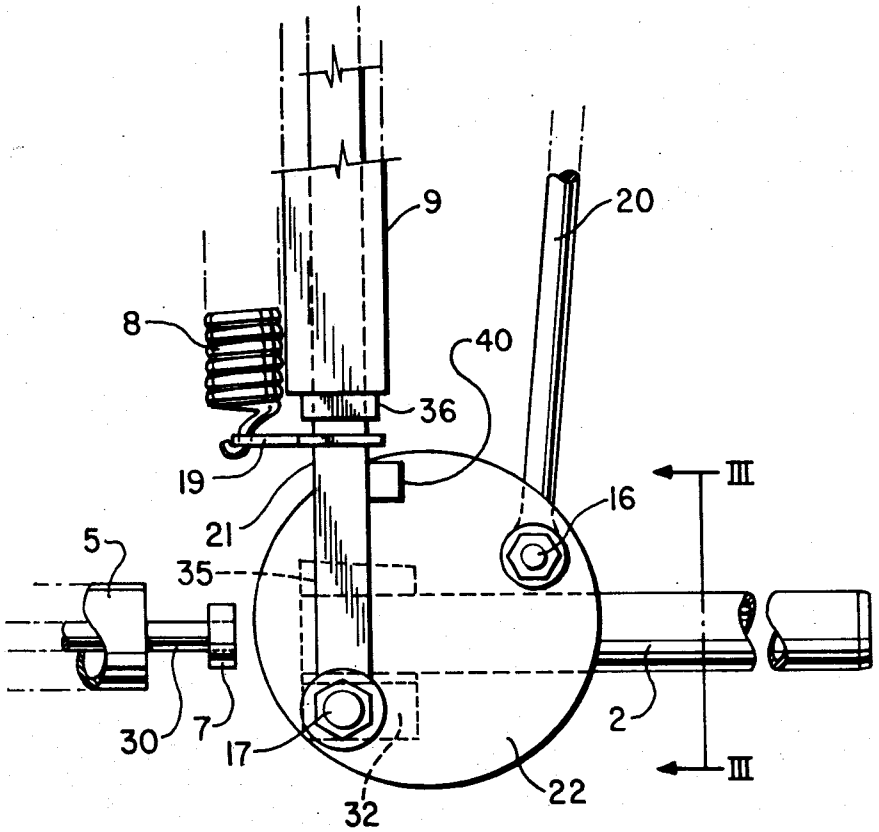
FIG. 2 is an enlarged plan view of a portion of the apparatus shown in FIG. 1.

The tension produced by the spring 8 tends to return the guide rod 21 to the position within the guide tube 9 as shown in FIG. 1 with a stop 36 (FIG. 2) on the guide rod 21 contacting the bottom of the guide tube 9 to prevent further upward movement of the guide rod 21.

Still referring to FIG. 1 there is shown a second hydraulic cylinder 5 which is attached at one end thereof to the back wall 11. A piston rod 30 is attached to a piston within cylinder 5. Hydraulic lines 28 and 29 which are connected to a hydraulic source via hydraulic valve control 25 and lines 37 and 38 are adapted to conduct fluid to and from the hydraulic cylinder to control movement of the piston rod 30.

Hydraulic valve unit 26 controls the flow of hydraulic fluid in lines 28 and 29 by means of electrically operated valves therein. The switches controlling the valves in the control unit 26 as well as the control unit 25 are located at the drivers station in the vehicle upon which the unit is mounted.

A piston rod 30 is attached to a piston within the cylinder 5 and is capable of substantially horizontal reciprocal movement along the axis of the sample probe 2 when the sample probe is in the sample discharge position. A bushing 7 on the end of the piston rod has an outside diameter less than the inside diameter of the bore of the sample probe 2 and serves to eject the sample from the probe 2 upon the outward movement of the piston rod 30.

A microswitch 6 is adapted to be contacted by the rod 30 to sense when the piston rod is in the fully withdrawn position. The microswitches 3 and 6 are electrically connected to the hydraulic valve unit 25 to control the flow of fluid to the cylinders 5 and 4. Specifically microswitch 3 prevents extension of the piston rod 30 except when the probe 2 is in the horizontal sample discharge position. Microswitch 6 prevents extension of piston rod 20 except when the piston rod 30 is in the fully retracted position.

Sample collecting container 1 is removably mounted in the housing so that the opening 31 in the container 1 is adjacent the forward end of the probe 2 when the latter is in the sample discharge position.

The apparatus according to the present is adapted to be mounted on the side of a truck or other vehicle with the controls situated in the cab to provide access by the operator. During transportation from one sampling site to another the probe is carried in the horizontal position as shown in FIG. 1.

Figure 4:
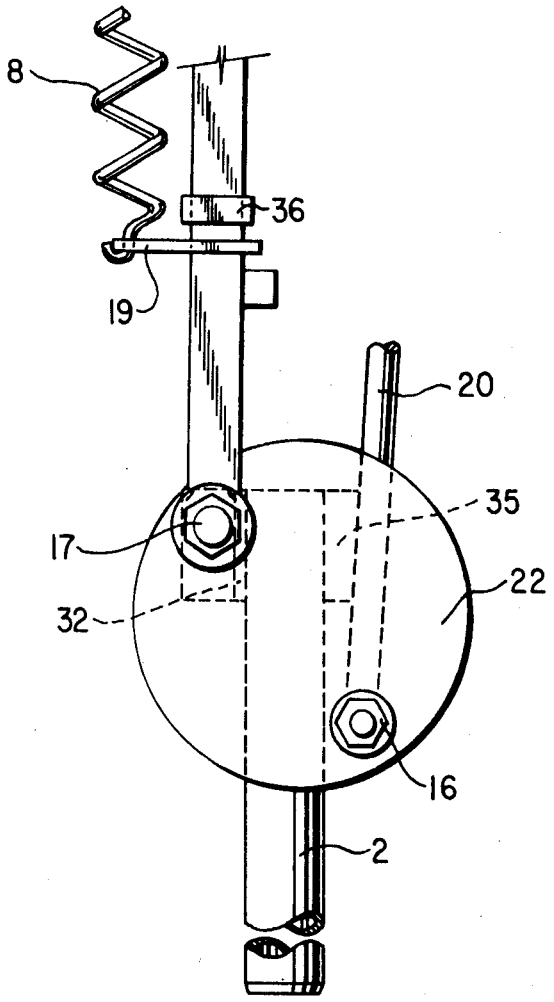
FIG. 4 is a view of the apparatus shown in FIG. 2 with the probe in a vertical position.

When a sampling site is reached the vehicle is stopped and the operator initiates the sample taking cycle by actuating an electrical switch situated at the drivers station which operates valves within the control unit 25. The operation of the valves serves to connect hydraulic lines 23 to the high pressure input line 37 and connects hydraulic line 24 to the hydraulic fluid return line 38. This causes downward pressure on the piston in cylinder 4 as a consequence of which there is downward movement of the piston rod 20. The tension on spring 8 tends to prevent movement of guide rod 21 as a result of which the pivot plate 22 and the attached probe 2 are caused to rotate in a clockwise direction about rotatable connector 17. As the pivot plate 22 and probe 2 continue to rotate the probe 2 contacts a stop 35 on the pivot plate 22 as shown in FIG. 4, thereby preventing further rotation of the plate 22 and probe 2. At this point the probe 2 is in the vertical position. As piston rod 20 continues to extend, the pivot plate 22 and attached probe 2, being constrained against further pivotal movement by the contact of the rod 20 against stop 35, commence downward vertical movement. The direction of downward movement at this stage is controlled by the guide 9 and guide rod 21 and is entirely a linear movement due to the fact the pivot plate is constrained against pivotal movement by contact of the rod 20 against stop 35 and the guide rod 21 is constrained by the guide 9 to move in a linear direction. As this movement continues the probe contacts and pierce the earth thereby collecting a sample of the earth in its core. As the plate 22 and probe 2 move downward the spring attachment bracket 19 on guide rod 21 also moves downward thereby increasing tension in the spring 8 which tends to continue to press the stop 35 against the rod 20 and to maintain the probe 2 in a vertical position.

When the probe has penetrated the earth a sufficient distance to obtain the necessary sample, the valves in control unit 25 are operated to cause hydraulic line 24 to be connected to the high pressure input line 37 and line 23 to be connected to the hydraulic fluid return line 38. This causes upward movement of the piston rod 20 together with the swivel plate 22 and probe 2. The tension on spring 8 maintains probe 2 in contact with stop 35 and hence maintains probe 2 in a vertical position.

As the plate 22 and probe 2 move upward the guide rod also continues to move upward until the stop 36 on the guide rod 21 contacts the bottom of the guide 9. At this point upward movement of the guide rod 21 is stopped and the continued retraction of the piston rod 20 causes the guide plate 22 to rotate in a counter clockwise direction about connector 17 which is now stationary. This counter clockwise movement of the guide plate 22 and probe 2 continues until a stop 40 on the outside of connector 16 contacts the guide rod 21 at a point which corresponds approximately with the end of the stroke of the piston rod 20. The probe is now in a substantially horizontal position wherein its cutting end is adjacent the opening 31 in the sample collecting container 1. With the activation of micro switch 3 the operation of piston 5 is no longer inhibited. In order to expel the sample from the probe, solenoid operated valves in controller unit 25 are operated to connect line 28 to the high pressure hydraulic input line 37 and to connect line 29 with the hydraulic fluid return line 38. This causes outward pressure on the piston in the cylinder 5 and movement of the piston rod toward the probe. Stop 40 is positioned so as to terminate upward movement of the probe 2 when its major axis is in alignment with piston rod 30. Thus the continued outward movement of the piston rod 30 causes bushing 7 thereon to enter the bore of the probe and to expel the sample in the bore into the sample container 1.

Following expulsion of the sample from the core of the probe 2 the valves of controller 25 connect line 29 to the high pressure hydraulic fluid input and connect line 28 to the low pressure return line thus causing piston rod 30 to withdraw from the bore of the probe. When the piston has been fully withdrawn the rod 30 no longer contacts micro switch 6 and the valves to lines 28 and 29 are closed. The apparatus is then ready to commence its next cycle.

It will be appreciated that the entire sequence of steps in the soil sampling cycle may be automated so that it is only necessary for the operator to initiate operation and the apparatus will complete the cycle without further action by the operator. It will also be appreciated that with this apparatus, once the probe has been withdrawn from the soil, the operator is able to start moving the vehicle to the next sampling site while the device completes the sequence without interfering with such movement.

What I claim as my invention is:

1. A soil sampling device comprising a probe assembly including a tubular probe, a probe assembly motive means, said probe assembly being pivotally attached at a first location thereon to said probe assembly motive means for limited pivotal movement relative thereto; a guide means, said guide means including a member mounted for linear reciprocal motion in the vertical direction, a first stop means on said member adapted to limit the upward movement thereof, said tubular probe assembly being pivotally attached at a second location thereon to said member, means to bias said member into its uppermost position, a second stop means on said probe assembly adapted to limit further pivotal movement of said probe assembly when the longitudinal axis of the probe is vertical, a soil sample receiving means having an opening therein for receiving soil samples from said tubular probe, wherein movement of said probe assembly motive means in a first direction initially causes said probe assembly to pivot about said first location thereon until the longitudinal axis of said probe is vertical at which position said second stop means prevents further rotation, thereafter continued movement of said probe assembly motive means in said first direction causes said probe to move downwardly in the direction of the longitudinal axis of said probe, penetrating the soil which it is sampling, and movement of said probe assembly motive means in a direction opposite to said first direction causes the probe to be withdrawn vertically upward from the soil at which point said first stop means prevents further upward movement of said second point on said probe assembly and continued movement of said motive means in said opposite direction causes said probe assembly to pivot about said second location thereon thereby moving said probe to a horizontal position.

2. A device as claimed in claim 1 wherein said probe is tubular and has a leading edge which is adapted to penetrate the soil and a rearward end, said probe including an axial bore extending therethrough from the leading edge to the rearward end thereof.

3. A device as claimed in claim 2 including a sample ejection means, said sample collecting means including an opening therein adjacent to the leading edge of the probe when the latter is in the horizontal position, said sample ejection means including a member having a diameter less than the diameter of the bore of the probe, said member of the sample ejection means being adapted to pass through the bore of the probe when the latter is in the horizontal position to cause material therein to be ejected into the sample collection means.

4. A device as claimed in claim 3 wherein said probe assembly motive means comprises a cylinder with a hydraulically operated reciprocal piston therein, and said sample ejection means comprises a hydraulic piston and cylinder.

5. A device as claimed in claim 4 wherein said apparatus is adapted to be mounted on a motor vehicle having a drivers station, said device including electrically operated hydraulic valves for controlling the flow of fluid to and from said cylinders and electrical controls adapted to be mounted in the motor vehicle at the operator's station for controlling operation of said hydraulic cylinders.

* * * * *